US009293850B2

(12) United States Patent
Gilliam

(10) Patent No.: US 9,293,850 B2
(45) Date of Patent: Mar. 22, 2016

(54) HIGH POWER ELECTRICAL CONNECTOR CONTACT

(71) Applicant: Charles David Gilliam, Baton Rouge, LA (US)

(72) Inventor: Charles David Gilliam, Baton Rouge, LA (US)

(73) Assignee: Hubbell Incorporated (Delaware), Shelton, CT (US)

( * ) Notice: Subject to any disclaimer, the term of this patent is extended or adjusted under 35 U.S.C. 154(b) by 412 days.

(21) Appl. No.: 13/953,832

(22) Filed: Jul. 30, 2013

(65) Prior Publication Data

US 2015/0038008 A1 Feb. 5, 2015

(51) Int. Cl.

| | |
|---|---|
| ***H01R 13/04*** | (2006.01) |
| *H01R 4/18* | (2006.01) |
| *H01R 24/76* | (2011.01) |
| *H01R 101/00* | (2006.01) |

(52) U.S. Cl.

CPC *H01R 13/04* (2013.01); *H01R 4/18* (2013.01); *H01R 24/76* (2013.01); *H01R 2101/00* (2013.01)

(58) Field of Classification Search

CPC ..... H01R 13/04; H01R 2101/00

See application file for complete search history.

(56) References Cited

U.S. PATENT DOCUMENTS

| | | | | | |
|---|---|---|---|---|---|
| 867,312 | A * | 10/1907 | Shutz | F16B 7/22 | 403/341 |
| 1,552,262 | A * | 9/1925 | Betz | H01R 13/04 | 361/809 |
| 1,975,244 | A * | 10/1934 | Wiseman | F16B 7/22 | 16/DIG. 41 |
| 2,456,764 | A * | 12/1948 | Bach | H01R 13/04 | 403/326 |
| 2,677,813 | A * | 5/1954 | Sharp | H01R 4/023 | 403/272 |
| 3,401,371 | A * | 9/1968 | Hammond | H01Q 1/088 | 174/84 S |
| 3,634,819 | A * | 1/1972 | Evans | H05K 3/308 | 439/751 |
| 3,694,792 | A * | 9/1972 | Wallo | H01R 4/2479 | 24/335 |
| 3,964,934 | A * | 6/1976 | Ching, Jr. | H01M 2/30 | 429/178 |
| 4,209,221 | A * | 6/1980 | Chupak | H01R 24/20 | 439/848 |
| 5,135,414 | A * | 8/1992 | van Dijk | H01R 13/04 | 439/660 |
| 5,487,686 | A * | 1/1996 | Sawada | H01R 13/04 | 439/692 |
| 5,775,963 | A * | 7/1998 | Byfield, Jr. | H01R 13/04 | 439/884 |
| 5,989,053 | A * | 11/1999 | Wheeler | H01R 13/04 | 439/387 |
| 6,004,172 | A * | 12/1999 | Kerek | H01R 13/10 | 439/879 |
| 6,077,096 | A * | 6/2000 | Moring | H01R 4/64 | 439/801 |
| 6,343,963 | B1 * | 2/2002 | Bronk | H01R 4/62 | 439/11 |
| 7,442,096 | B1 * | 10/2008 | Gilliam | H01R 13/44 | 439/149 |
| 8,328,569 | B2 * | 12/2012 | Roscizewski | H01R 4/26 | 439/187 |
| 2013/0171871 | A1 * | 7/2013 | Gilliam | H01R 13/6581 | 439/607.01 |
| 2014/0073161 | A1 * | 3/2014 | Winningham | H01R 13/521 | 439/271 |
| 2015/0038008 | A1 * | 2/2015 | Gilliam | H01R 13/04 | 439/571 |
| 2015/0038021 | A1 * | 2/2015 | Gilliam | H01R 13/502 | 439/730 |

* cited by examiner

*Primary Examiner* — James Harvey

(74) *Attorney, Agent, or Firm* — Roy Kiesel Ford Doody & Thurmon

(57) ABSTRACT

A high power, single pole male electrical connector with a reduced surface area contact is disclosed. The male connector is configured for insertion into a female connector of standard design. The reduced surface area of the contact region of the male connector results in less surface contact between the male and female connectors.

19 Claims, 4 Drawing Sheets

HIGH POWER ELECTRICAL CONNECTOR CONTACT

FIELD OF INVENTION

The present invention relates to an electrical connector, and in particular to a high power, single pole male electrical connector having a reduced electrical contact area.

BACKGROUND AND SUMMARY OF THE INVENTION

Single pole electrical connectors are used in a variety of settings. High power, single pole connectors are used in many industrial settings, and are particularly suitable to situations requiring some degree of portability. In other words, when the electrical system must be transported using a standardized delivery platform (e.g., a standard 18-wheel truck) and then made up on site, single pole connectors are often used. These connectors typically allow for relatively simple installation and break down when a job is completed.

A common type of single pole connector uses mated male and female individual connectors. For example, an electrical supply panel may be used to install a number of panel-mounted connectors. This might be male or female, but in this example, we will assume the panel-mounted connectors are female. Electrical cables extend from the panel to various electrical loads (e.g., large motors, pumps, or other electrical machinery). To connect the cable to the panel, a male cable-end connector is used. This male is inserted into the panel-mounted female connector, thus completing the circuit. When the installation must be broken down, the male cable-end connectors are removed from the female panel-mounted connectors.

Outdoor carnivals and concerts may use these types of connectors to supply electrical power to their various loads. The oil and gas industry, especially land-based operations, often use high power, single pole electrical connectors. In the oil and gas industry, land-based operations often require that all materials be transported via standard 18-wheel trucks. In part for that reason, single pole connectors of the type disclosed herein have become widely used. And because the electrical loads used on land-based oil or gas drilling rigs can be very large, the electrical connectors used are also typically very large. Connectors rated for 1,000 amps or more are common in this industrial setting. Such connectors are physically large, too, sometimes weighing several pounds.

These large single pole electrical connectors have large contacts. For example, a male, single pole electrical connector rated for 1,000 amps or more might have a cylindrical contact surface nearly one inch in diameter and three inches in length. The mated female connector would have an inside diameter matched to that of the outside diameter of the male. These two parts are designed for a very tight fit, to ensure the best possible electrical connection between the male and female contacts. Manufacturing tolerances for these components are typically in the thousandths of an inch.

The prior art design, which was very briefly described above, provides an adequate electrical connection in most situations. But to obtain that electrical connection, the prior art design sometimes requires substantial force to make up the connection. The fit between the male and female connectors is very tight. And with as much a three inches of linear contact surface, the surface friction between the male and female can be quite substantial. Moreover, the surface friction only increases as the connector is made up, because the surface contact between the male and female increases. That fact can make it difficult to fully insert a male connector into a female. When that happens, it can be difficult, if not impossible, to complete the connection.

These types of connectors have various types of locking mechanisms to ensure the male and female connectors remain engaged during use. The locking mechanisms may only be engaged when the male and female connectors are fully engaged, that is, only when the male has been fully inserted into the female. The increasing surface friction described above can make this difficult. And if the male and female components cannot be fully made up, the locking mechanisms may not be usable. When this happens, the connection must be unmade and replaced. Failure to do so (a failure that can and does occur in the field), will result in a live, high power connection that is not locked together. This result can be extremely dangerous, because if a high power single pole connection of the type described herein is pulled apart under power, an enormous spark or arc will be produced. Explosion or fire is possible under such circumstances. The severity of the risk created by this situation cannot be overstated.

On the other hand, it is critical that these types of electrical connectors provide adequate electrical conductivity between the male and female components. If the electrical connection is poor—that is, if there is too much electrical resistance at the contacts—the connection will generate heat (i.e., electrical resistive heating). Given the high current passing through some of these connectors, such heating can be rapid and extreme. It can easily be severe enough to damage, perhaps even break down, the insulation in the connector or on the cable. If the insulation is lost, sparking or arcing can occur, and the same catastrophic results mentioned above may follow.

There are, therefore, two serious risks posed by use of these types of electrical connectors. First, if the extreme surface friction between the male and female components prevents full engagement, an unlocked connection is possible. This can lead to pull out under power, which is extremely dangerous. Second, if the electrical connection between the male and female components is not adequate, extreme heating can occur. This can lead to insulation damage, which is also extremely dangerous.

Reducing one of these risks may increase the other. That is, the surface friction between the male and female contacts may be reduced by increasing the gap between these two components. That is, by relaxing the fit between the male and female, by making it less tight, the surface friction will be reduced, thus making it easier to make up and lock the connections. But relaxing the fit between the male and female may increase the electrical resistance between the contacts, thus leading to excessive resistive heating and the damage that can cause.

On the other hand, resistive heating may be reduced by ensuring the best possible physical engagement between the male and female contacts. To date, this solution has prevailed. High power, single pole electrical connectors tend to maximize the surface contact between the male and female contacts to ensure there is a good electrical connection. This approach, however, results in connectors that are often very difficult to make up in the field. Given that these operations sometimes occur in challenging weather conditions, with workers under pressure to complete the electrical system, it is not surprising to find that some high power, single pole connections are not fully locked prior to use, despite the hazards associated with this situation. Or alternatively, if the electricians are conscientious and make certain that every connection is properly installed and locked, the prior art designs can cause time delays that are very costly to operations.

One alternative to the traditional prior art design discussed above is to use an inserted, multi-piece contact. Such an approach typically involves installation of the multi-piece contact inside the female connector. A recess is machined into the contact surface region of the female connector, and a separate, multi-piece contact is inserted into the recess. The male connector makes primary contact with the multi-piece contact, rather than with the entire length of the female connector's contact region. This approach can greatly reduce the surface friction described above, and can facilitate better connections in field use.

There are, however, some drawbacks to the multi-piece contact design. First, it involves use of a precision, multi-piece contact, in which each individual contact is able to move somewhat independently of the other contacts. This effectively means the contact has many parts that are all able to move. This also means the contact has many, small parts that can break or jam in use. When there are more pieces or parts, there are more chances for failure or breakdown, and the multi-piece contact design is subject to that concern.

The many contacts are typically made of special materials and are subject to very demanding manufacturing specifications. These requirements result in an expensive component, and for this reason, the multi-piece contact approach will increase the cost of the connector. This cost increase can be quite substantial. In some situations, the benefits may justify the higher cost of this design. Nevertheless, a lower-cost design that provides the same or similar benefits would have value in the market.

The multi-piece contact design also creates a compatibility issue. When a multi-piece contact of the type very briefly described above is installed in a female connector, one of two other changes is necessary. The goal of this design is for the multi-piece contact to constitute the sole, or at least primary, contact section. That is, the only area where the female and male connectors will make electrical contact is at the multi-piece contact, which will make contact with an inserted male connector.

To make this work, the fit between the male and female contact regions must be substantially relaxed. Either the inside diameter of the female contact region must be larger or the outside diameter of the male contact must be smaller. Either solution will work, because both will result in much less contact between the general contact surfaces of the male and female connectors. The multi-piece contact installed in the female will extend outward from the rest of the female contact surface area, thus pressing the many individual contacts of the multi-piece contact against part of the male connector. The rest of the male connector's contact surface will make only minimal or intermittent physical contact with the rest of the female connector's contact surface. The primary, perhaps exclusive, area of physical connection within the contact regions will be the multi-piece contact pressing against a relatively small part of the male contact.

Because the fit is greatly relaxed between the male and female connector in this approach, connectors using the multi-piece contact may not be compatible with other designs.

Assume, for example, the male contact diameter is reduced to make the multi-piece contact design work. Such a male connector could not be used with a prior art female connector, because doing so would result in too loose a fit between the male and female. Such a loose fit could result in poor electrical conductivity and the dire results described above. Similarly, if a female connector has an increased inside diameter, it would not work well with prior art male connectors.

This is largely a backward compatibility issue, and it can be quite important. There are thousands of connectors of the general type discussed here in use in the field. If some of those are replaced with a multi-piece contact design of the type described above, there would be incompatible components in use on a single job site. That can be a dangerous situation. There are significant advantages to designs with full backward compatibility. The multi-piece contact solution typically lacks backward compatibility.

For these reasons, there is a need for a simpler, lower-cost solution that provides full backward compatibility. The present invention provides such a solution. To understand the present invention, it is helpful to begin by recognizing the types of electrical resistance present in single pole connectors of the general type discussed here.

Two types of resistance are present: bulk resistance and contact resistance. The bulk resistance is fixed and results from the type of conductor used, the length of the electrical flow path through the conductor, and the size of the conductor. The single pole connectors discussed here use cylindrical core conductors, typically of very low resistance copper. The bulk resistance of such connectors is low, and is proportional to the cross-sectional area of the smallest diameter section of the core conductor.

$$R_B \alpha a_1$$

Where $R_B$ represents the bulk resistance and $a_1$ represents the cross-sectional area of the smallest diameter point of the core conductor. The cross-sectional area is proportional to the diameter:

$$a_1 = \pi r_1^2$$

Where $r_1$ represents the radius of the core conductor at its smallest point. This value will be determined by the size of the connector, with higher current rated connectors having larger core conductors, and thus lower bulk resistance. But for any given connector, the bulk resistance is relatively constant.

The contact resistance is the electrical resistance at the point of physical contact between two connectors. In the single-pole connectors discussed here, the contact resistance is the key concern. This resistance is highly variable, as it depends upon the fit between the male and female contacts, the extent to which oxide layers have formed on the contact surfaces, and so on.

It has been found, however, that contact conductivity (i.e., the inverse of resistance) is generally proportional to the pressure at the point of contact between the male and female contact surfaces.

$$C_C \alpha P_C$$

Where $C_C$ represents the contact conductivity (i.e., the inverse of resistance) and $P_C$ represents the pressure at the point of contact. The pressure depends upon the force and the contact area, as follows:

$$P_C = F_C / A_C$$

Where $F_C$ represents the normal force at the point of contact and $A_C$ represents the contact surface area. The area in this equation is a surface area, not a cross-sectional area. The capital "A" is used in this equation to emphasize this point.

Given these principles, it can be seen that the contact conductivity is proportional to the normal force and is inversely proportional to the contact surface area. The first point is intuitive. The more force pressing the contact surfaces together, the greater the electrical conductivity (i.e., less electrical resistance) between the contacts. This intuitive result is driven by at least two important physical results of the increased force. First, when more force is exerted, the many, tiny peaks and valleys on the actual contact surfaces are pressed against each other, thus resulting in more actual physical contact between the two surfaces. Second, when more force is exerted, any film layers (e.g., dirt, grease, or oxides) are reduced or eliminated at the points of contact.

The second point that follows from this equation, however, is counter intuitive, at least when working in the area of high-power, single-pole electrical connectors. The contact conductivity is inversely proportional to the contact surface area. This means that as the contact surface area decreases, the conductivity increases. In theory, this would mean a very small contact point between the male and female connectors would result in the maximum contact conductivity. And for small current signals, this result generally holds. But for large currents, there are limits to the application of this principle.

A large part of the contact resistance in high-power connectors is constriction resistance, which depends upon the actual physical contact area. If the points of physical contact are reduced too much, the current flow becomes constricted at the point of contact, and contact resistance increases. How much contact area is needed depends on how large the currents are within the connectors. For high-power, single-pole connectors of the type discussed here, constriction resistance limits how small the contact area may be.

A practical, working set of limits for these variables has been determined. These connectors are typically rated based on the sizing of the core conductors. Thus, the ratings of these connectors depend primarily on the bulk resistance, which varies with the cross-section area of the smallest diameter point of the core conductor. It follows, therefore, that the contact resistance should remain equal to or less than the bulk resistance. Otherwise, the contact resistance could become limiting, and in use, could result in overall resistance values that are too high, values that could result in excessive resistive heating of the connection.

It has been determined that by maintaining the total contact surface area within about 25% of the cross-sectional area of the smallest point of the core conductor, the contact resistance will remain approximately equal to or less than the bulk resistance of the connector. In other words, by ensuring that the total contact surface area is at least 75% of the cross-sectional area of the smallest point of the core conductor, satisfactory performance is ensured. To be fully clear, satisfactory performance is defined here as maintaining the contact resistance at or below the bulk resistance of the connector's core conductor. As long as this relationship exists, the contact resistance is not limiting.

These findings are highly significant, because they allow for a much smaller contact region than has been used in prior art connectors. Where a typical prior art connector may have male and female contact regions that are between two and three inches in length, the current invention is able to use a male contact surface that is substantially less than one inch in length, while maintaining the contact resistance within reasonable limits. This result is highly advantageous because it greatly reduces the sliding surface friction between the male and female contacts. With less friction, less force is needed to make up the connections. These beneficial results are obtained through use of a simple, single-piece contact that is fully backward compatible.

The sliding friction concern discussed above (i.e., the difficulty in making up or breaking down these connectors due to the tight fit between male and female connectors) can be reduced in two ways. First, the force between the contacts may be reduced. This can be done by relaxing the tight fit between the male and female, either by changing manufacturing specifications or by reducing the outward spring tension on the internal spring of the male contact (more fully discussed in connection with FIGS. 7-8 below). Second, the area of physical contact may be reduced. If there is less contact area between the male and female contacts, there will be less sliding friction between them.

The present invention allows use of both. The goal is to maintain acceptable contact conductivity. If the normal force between the contacts is reduced, the contact conductivity decreases. If the contact surface area decreases, the contact conductivity increases. Thus, it is possible to maintain acceptable contact conductivity by reducing both the normal force and the contact surface area. These two changes have a cumulative effect on the contact sliding friction, but have counter effects on the contact conductivity.

The present invention, in a preferred embodiment, is a single-pole, male electrical connector having a generally cylindrical core conductor with a minimum cross-section area of $a_1$, a contact surface with an effective surface area of $A_{Ceff}$, wherein $A_{Ceff} \geq 0.75\ a_1$. In a preferred embodiment, the contact surface is generally cylindrical and smooth, such that $A_C = \pi d_C l_C$, where $d_C$ represents the diameter of the contact region and $l_C$ represents the axial length of the contact surface. In this embodiment, $A_{Ceff} = A_C$. When these equations are combined for this embodiment, we see that:

$$\pi d_C l_C \geq 0.75 \pi r_1^2$$

It follows, therefore, that, $$l_C \geq 0.75 r_1^2 / d_C$$

To use sample figures, assume the minimum core conductor diameter is 1 inch, and the contact diameter is 1.05. For a male contact with these dimensions, the contact surface length should be at least approximately 0.18 inch. Compare that to a prior art male contact surface of two to three inches in length. The male contact may be of any size beyond this minimum, so long as the contact is short enough to substantially reduce the sliding friction between the male and female contacts.

In another embodiment, the contact surface is irregular, with grooves or other cuttings made into its surface. In such an embodiment, the effective surface area is $A_{Ceff} = A_C - A_{REM}$, where $A_{REM}$ represents the portion of the contact surface area removed. This embodiment is described in more detail below, and a sample calculation is provided.

DETAILED DESCRIPTION OF THE DRAWINGS

Figure 1:
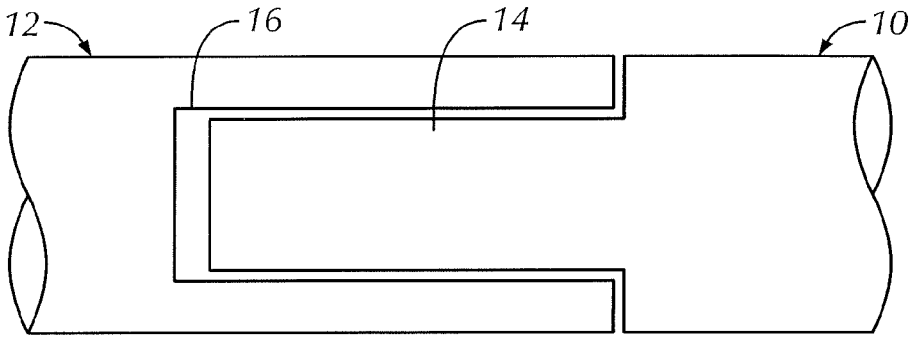
FIG. 1 (Prior Art)
FIG. 1 is a diagrammatical, cross-section of a prior art connection.
Figure 2:
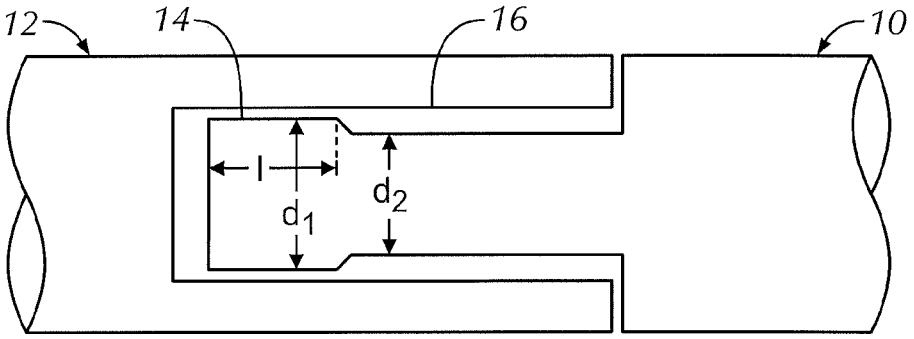
FIG. 2 is a diagrammatical, cross-section of the present invention.
Figure 2A:
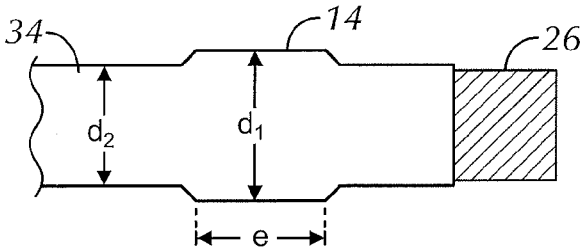
FIG. 2A is a diagrammatical, cross-section of the contact region of a connector embodying the present invention.

FIGS. 1, 2, and 2A show the prior art and present invention in diagram form. The prior art design is seen in FIG. 1, which includes a male connector 10, a female connector 12, a male contact surface 14 and a female contact surface 16. As can be seen the male and female contact regions are in physical contact along most of their length. In a typical high-power connector, these contact surfaces are between two and three inches in length and about ¾ to 1 inch in diameter (i.e., the outside diameter of the male contact).

The present invention differs markedly from the prior art design. FIG. 2 shows a male connector 10, a female connector 12, a male contact surface 14 and a female contact surface 16, just as in FIG. 1. But the male contact surface 14 is much shorter in the present invention. FIGS. 2 and 2A show three important dimensions: l, $d_1$, and $d_2$, where l represents the length of the male contact surface 14, $d_1$ represents the diameter of the male contact surface 14, and $d_2$ represents the minimum diameter of the core conductor 34 of the male connector. FIG. 2A also shows a dead head tip 26, which is described more below.

Note that l, the length of the male contact surface 14, is shown at about ⅓ the length of the female contact surface 16 in FIG. 2. This smaller male contact surface provides the benefits described above, while maintaining adequate contact conductivity.

The difference between $d_1$, and $d_2$ has been exaggerated in all the figures to better show the difference between the male core conductor 34 diameter and the diameter of the male contact surface 14. In practice, these diameters are much closer. In fact, the core conductor 34 is reduced in size only enough to avoid sliding friction with the female contact surface 16. A difference of one one-hundredth of an inch may be sufficient for these purposes, which demonstrates how close $d_1$, and $d_2$ may be in actual connectors embodying the present invention.

This point is important, because the bulk resistance increases as $d_2$, the minimum diameter of the core conductor 34, decreases. If the core conductor 34 were substantially reduced in diameter, the connector may not be able to sustain the same current rating. But only a very small reduction in the core conductor 34 diameter is needed with the present invention. Such a slight reduction in the diameter of the core conductor 34 does not materially change the bulk resistance of the connector, and as a result connectors with the present invention maintain the same power ratings as the prior art connectors with which they are compatible.

Figure 3:
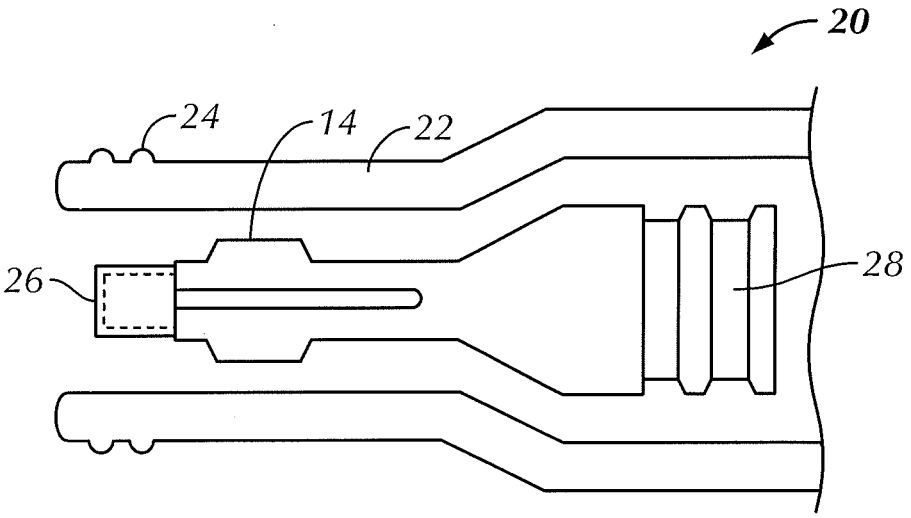
FIG. 3 is a cross-sectional view of a male, cable-end connector with a preferred embodiment of the present invention.
Figure 4:
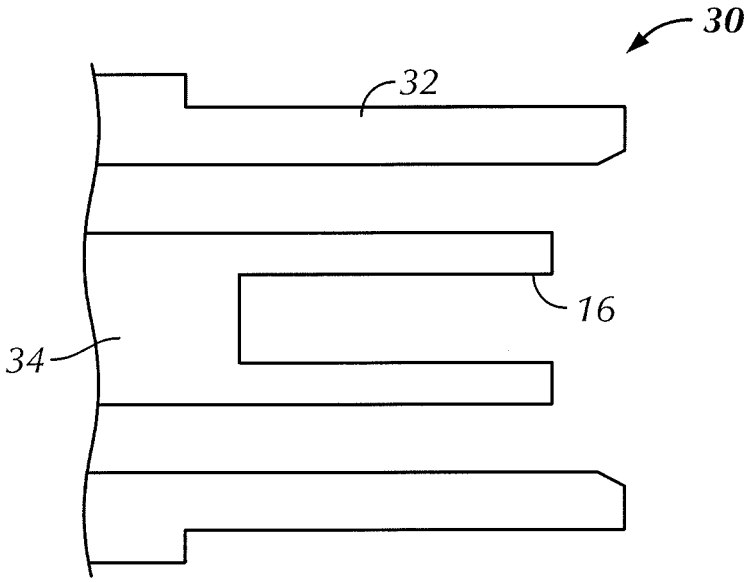
FIG. 4 is a cross-sectional view of a female, panel-mounted connector.

FIGS. 3-4 show a typical pair of connectors, with the male embodying the present invention and the female of standard, prior art design. FIG. 3 shows a male cable end plug 20 having outer insulation 22. The insulation may be made of various materials, but it is preferred to use a strong, flexible material capable of withstanding high temperatures. There are flexible seals 24 located around the outer periphery of the distal end of the outer insulation 22. A deadhead cap 26 is shown, too. Such a cap provides protection, by insulating the distal end of the core conductor. The length of the deadhead cap 26 is exaggerated in the drawing. In practice, the cap may be relatively short. A male contact surface 14 similar to that described above is also shown in FIG. 3. The male cable end plug 20 is attached to a cable by crimping the core conductor to the cable at the cable crimp section 28.

The basic elements of a typical prior art female panel mount receptacle 30 are shown in FIG. 4. The outer insulation 32 extends outward from the panel (not shown). A rigid housing (now shown) is mounted on a panel, and the components shown in FIG. 4 are housed within the rigid housing. The female conductor 34 is also shown is FIG. 4, as is the female contact surface 16. These features are all of common, prior art type.

To make up a connection, the male cable end plug 20 is inserted into a female receptacle 30. When this is done, the flexible seals 24 of the outer insulation 22 of the male plug 20 come into contact with the inside of the female's outer insulation 32. The seals 24 provide a water tight seal by pressing against the female outer insulation 32. The deadhead cap 26 enters the female contact region, and the male contact surface 14 makes contact with the female contact surface 16. Given the smaller area of the male contact surface 14 (as compared to prior art male designs), the sliding friction between the male and female components in substantially reduced.

Figure 5:
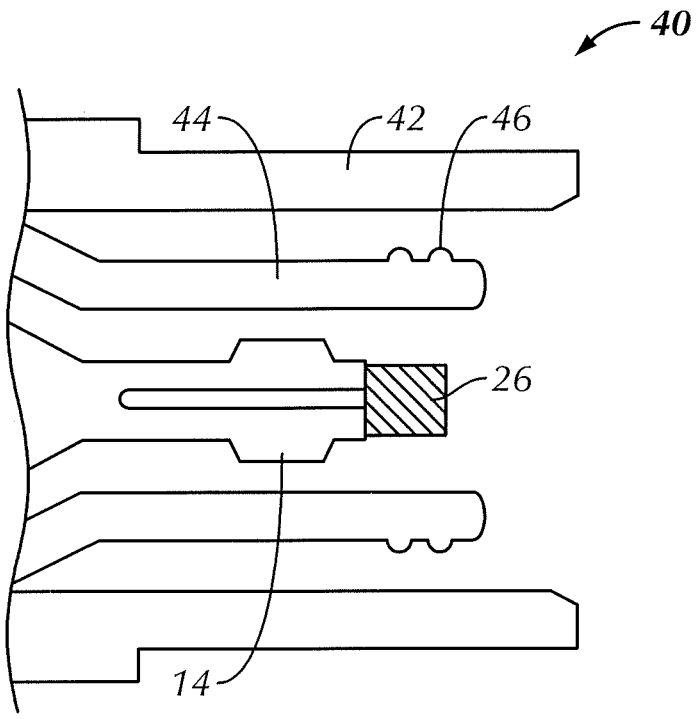
FIG. 5 is a cross-sectional view of a male, panel-mounted connector with a preferred embodiment of the present invention.
Figure 6:
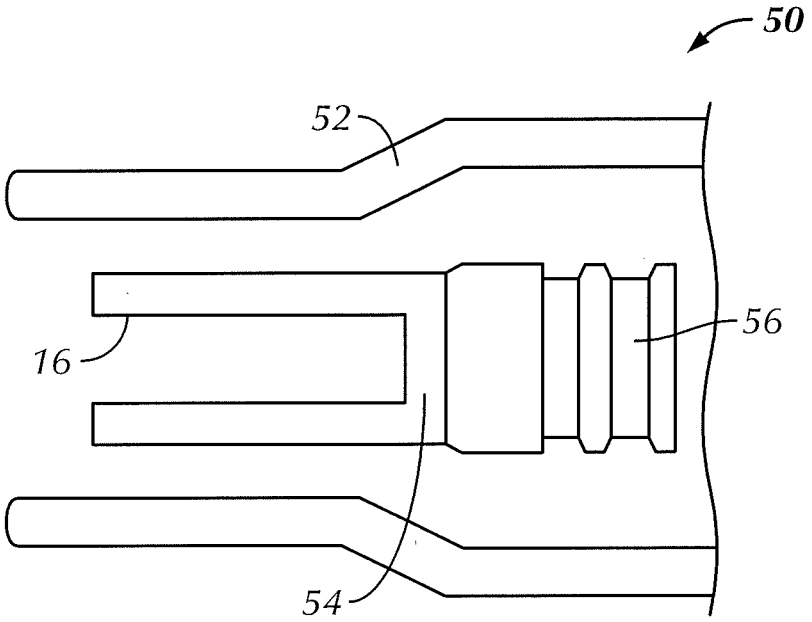
FIG. 6 is a cross-sectional view of a female, cable-end connector.

A panel mount male receptacle 40 is shown in FIG. 5. A female cable end plug 50 is shown in FIG. 6. To make up this connection, the female plug 50 is inserted into the male receptacle 40. A rigid outer housing 42 is shown in FIG. 5. This is the housing that is mounted to a distribution panel. Then the female plug 50 is inserted into the male receptacle 40, the female outer insulation 52 first enters the space between the rigid housing 42 and the male outer insulation 44. The flexible seals 46 engage with the female outer insulation 52. The female contact surface 16 engages with the reduced length male contact surface 14, thus completing the connection. In a typical installation, some type of locking mechanism is used to ensure the connection remains secure once it has been fully made up.

FIGS. 3-6 demonstrate the backward compatibility of the present invention. In both configurations, the female connector is of prior art design. The improved male connector of the present invention works with a conventional, prior art female connector. This is true regardless of whether the improved male connector is a cable-end plug or a panel-mount receptacle. Thus, the present invention allows users to obtain the benefits merely by adopted the improved male connectors. These connectors may replace any prior art male connector without causing any compatibility issues. This result is highly beneficial in an industry where errors caused by incompatible equipment can be very costly.

These figures also illustrate that the invention lies in the design of the contact region of the core conductor, and not in the other parts of the male connector. Indeed, only the core conductor of a prior art male connector must be modified to take advantage of the present invention. The same core conductors may be used in a cable-end plug connector or a panel-mount receptacle connector.

Figure 7:
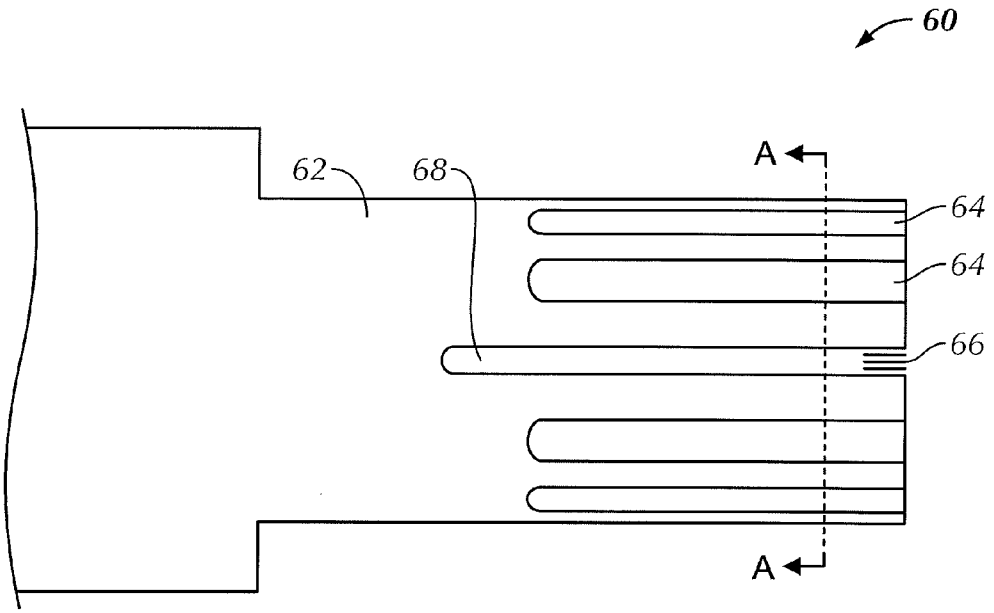
FIG. 7 is a side-view of an alternative embodiment of the present invention.

In FIG. 7, an alternative embodiment is shown. The male contact region 60 extends from a male core conductor 62. There are grooves 64 cut into the surface of the male contact, and there is a tensioning mechanism 66 positioned within the expansion slot 68. These features are shown in more detail in FIG. 8, which is an enlarged, end-view cross-section of the embodiment shown in FIG. 7.

FIG. 7 also better illustrates a basic aspect of the male connectors discussed here. In the typical prior art design, the male contact has a longitudinal expansion slot 68 that extends from the distal end to a point near the opposite end of the contact region. Within the expansion slot 68 is a tensioning mechanism 66, which is used to force the two lobes of the male contact region apart. By doing do, greater force is exerted between the male and female contacts. This design allows for fine adjustments to ensure there is tight fit between the male and female. Preferred embodiments of the present invention use the same expansion slot design, but do not require as much outward force.

Figure 8:
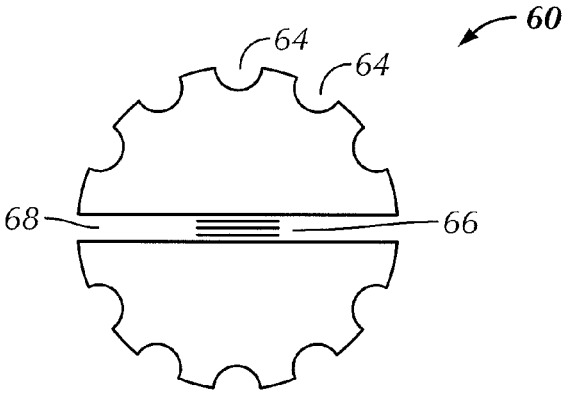
FIG. 8 is an end-view, cross-section of the embodiment shown in FIG. 7.

The embodiment shown in FIGS. 7 and 8 has a number of grooves 64 cut into the surface. The grooves 64 are shown in FIG. 8 as semi-cylindrical in shape, but any shape cut can be used. The cuts need not be regular, nor do they need to extend longitudinally, as shown in FIG. 8. The purpose of the grooves 64 is to remove surface area from the male contact region. This could be done in many different ways. The longitudinal grooves 64 are but one example. Shallow holes may be drilled into the surface of the male contact to remove surface area, and such holes may be positioned regularly or irregularly around the surface of the contact region 60. Spiral grooves (i.e., resembling threads) or circumferential grooves could be used. Any process that removes surface area could achieve the desired result.

This embodiment has the advantage of allowing for retrofit of existing male connectors by removing some of the surface area. This removal would reduce the sliding friction while maintaining adequate contact conductivity. Retrofits of this manner might even be possible in the field. This embodiment would also allow for a large supply of existing inventory to be retrofitted to incorporate the advantages of the present invention.

When this embodiment of the invention is used, one may determine how much surface area may be removed. The equations provided above may be used for this purpose. If $A_{REM}$ represents the contact surface area removed, then the effective surface area is $A_{Ceff}=A_C-A_{REM}$, where $A_C$ represents the contact surface area that existed prior to the removal. If, for example, a cylindrical contact surface is three inches long and 1 inch in diameter, then $A_C\approx 9.4$ in$^2$. Using 1 inch for the minimum core conductor diameter, yields a cross-sectional area (i.e., $a_1$) of 0.785 in$^2$. Because $A_{Ceff}\geq 0.75\ a_1$, it follows that $A_{Ceff}\geq 0.589$ in$^2$ for this embodiment. $A_{REM}=A_C-A_{Ceff}$, and therefore, $A_{REM}\leq 8.8$ in$^2$. These calculations confirm that a large portion of the surface area may be removed, consistent with the present invention.

As noted above, when the preferred embodiment shown in FIGS. 2, 3, and 5 is used, the calculations are quite simple. An example was provided above, showing that a male contact surface less than 0.2" in length can be used with a connector having a minimum core conductor diameter of 1 inch and a male contact surface diameter of 1.05 inch. But what is the maximum length for the contact surface?

The present invention is not subject to a precise maximum for the contact surface area, but the contact surface area must be reduced by enough to substantially reduce the sliding friction between the male and female contacts. No precise equations or empirical relationships have been found to fix a clear limit on the maximum size of the male contact surface area. It has been found, however, that as long as the male contact surface area is at least 25% less than that of the typical prior art design, significant reduction in the sliding friction is achieved. For that reason, the present invention is limited on the maximum end by 75% of the total surface area of the male contact region.

Extending the prior example illustrates how this upper limit works. Assume the male connector described above (i.e., the one with the minimum core conductor diameter of 1 inch and a male contact surface diameter of 1.05 inch) has a 3 inch-long contact region. The minimum length of the male contact surface is about 0.2", as we saw above. The maximum length is 75% of the total contact region length, or 0.75×3.0, which is 2.25". This maximum is several times longer than is needed to maintain acceptable contact conductivity, and it probably is much longer than would be desired. But even at this length, the sliding friction between the male and female contacts is reduced, and in some applications even this reduction may be sufficient.

Combining the equations for the preferred embodiment shown in FIGS. 2, 3, and 5 (i.e., generally smooth, cylindrical raised male contact surface) results in the following:

$$0.75l_{Cfull}\geq l_C\geq 0.75r_1^2/d_C$$

where $l_{Cfull}$ represents the full length of the male contact region. Using the example provided above, produces the following results $$2.25''\geq l_C\geq 0.2''.$$

Similarly, for the alternative embodiment where part of the male contact surface area is removed, it has been found that a removal of at least 25% of the full surface area results in a substantial reduction in sliding friction. Therefore, it follows that for the alternative embodiment shown in FIGS. 7-8, $$0.75A_C\geq A_{Ceff}\geq 0.75a_1.$$

$$A_C=\pi d_C l_{Cfull}, \text{ and } a_1=\pi r_1^2.$$

Finally, we can define $A_{Cfull}$ as the approximate surface area of the full length of the male contact region with no surface removed (except, of course, for the surface gaps caused by the expansion slot), and equate this with the term $A_C$, as defined above. This is an approximation for both embodiments. For the alternate embodiment shown in FIGS. 7-8, this approximation does not account for the surface gap due to the expansion slot. This is acceptable, because this parameter is being defined for use in fixing an upper limit to the surface area of the male contact surface.

For the preferred embodiment shown in FIGS. 2, 3, and 5, this term is a further approximation because it uses the diameter of the contact surface, which is slightly larger than the diameter of the rest of the male contact region, a characteristic that can be clearly seen in the drawings. But because the difference in these two diameters is quite small for actual connectors, the approximation is quite close. The figures used in prior examples give a good illustration of this point.

Assume, for example, a male contact with a full contact region length of 3", a contact surface length of ½", a contact diameter of 1.0", and a minimum core conductor diameter of 0.95". The actual surface area is the combination of that for the slightly raised contact area plus the surface area of the rest of the contact region, or $$\pi\times 1.0\times 0.5+\pi\times 0.95\times 2.5\approx 9.0 \text{ in}^2.$$

Using the approximation, on the other hand, yields the following results (as shown above):

$$\pi\times 1.0\times 3.0\approx 9.4 \text{ in}^2.$$

These results are sufficiently accurate for use in fixing an upper limit to the size of the contact surface area for the present invention. Thus, we can use the following limits on the contact surface area for all embodiments of the present invention:

$$0.75A_C\geq A_{Ceff}\geq 0.75a_1.$$

$A_{Ceff}$ ultimately represents the actual surface area of the male electrical contact surface, regardless of the embodiment.

The tensioning mechanism 66 (see FIGS. 7 and 8) may be used the slightly reduce the force when the present invention is used. In many situations, no such adjustment would be needed, because the reduced contact surface area alone will provide a sufficient reduction in the sliding friction. But if a particular connection is difficult even with the reduced contact surface, the force can be reduced. This follows from the fact that by reducing the contact area, the pressure increases, which increases the conductivity. The force can be reduced slightly, and the end result will be a contact conductivity the remains at or above that of prior art designs.

The embodiment of the invention shown in FIGS. 2, 3, and 5 provides a wiping advantage, too. In the field, connectors can become dirty. Grease, dirt, sand, and other foreign materials can make their way into the connectors. Assume, for example, that a panel-mount female connector of the type generally shown in FIG. 4 is installed, but before a male plug is inserted, grease gets onto the female contact surface 16. When the male plug 20 of the present invention is inserted, the reduced size male contact surface 14 will wipe the grease from the female contact surface 16. The small space between the slightly reduced diameter part of the male contact region and the female contact provides enough space for the wiped grease or dirt, thus keeping the contaminant off the actual contact surface.

Prior art male connectors do not provide this wiping benefit because there is no place for the wiped contaminants to go. In a prior art connection, the distal edge of the male connector will have a wiping effect. But as the male is inserted more fully into the female, the contaminants become compressed in a very small space, and may eventually be forced back into the very small space between the male and female contact surfaces. If this occurs, the contaminant could significantly increase contact resistance. This result is prevented by the wiping benefit of the present invention.

While the preceding description is intended to provide an understanding of the present invention, it is to be understood that the present invention is not limited to the disclosed embodiments. To the contrary, the present invention is intended to cover modifications and variations on the structure and methods described above and all other equivalent arrangements that are within the scope and spirit of the following claims.

The invention claimed is:

1. A core conductor for a male, single-pole electrical connector comprising:

a generally cylindrical body with a minimum radius $r_1$ and a minimum cross-sectional area $a_1$;

an electrical contact region having an approximate total surface area $A_C$; and, an electrical contact surface area $A_{Ceff}$ within the electrical contact region, wherein: $0.75\ A_C \geq A_{Ceff} \geq 0.75\ a_1$.

2. The core conductor of claim 1, wherein $0.5\ A_C \geq A_{Ceff} \geq a_1$.

3. The core conductor of claim 1, wherein $0.5\ A_C \geq A_{Ceff} \geq 0.9\ a_1$.

4. The core conductor of claim 1, wherein the electrical contact region further comprises a non-contact area $A_{REM}$, which is defined as $A_{REM} = A_C - A_{Ceff}$.

5. The core conductor of claim 4, wherein the non-contact area has a diameter approximately equal to the diameter of the electrical contact surface area.

6. The core conductor of claim 5, wherein the non-contact area comprises a region from which the surface layer of the core conductor has been removed.

7. The core conductor of claim 5, wherein the non-contact area comprises grooves cut into the surface of the core conductor.

8. The core conductor of claim 5, wherein the non-contact area comprises shallow holes in the surface of the core conductor.

9. The core conductor of claim 1, wherein the electrical contact region has a total length $l_{Cfull}$;

the electrical contact surface area is generally smooth with a length $l_C$ and a diameter $d_C$, wherein the following are true:

$$d_C > 2r_1; \text{ and,}$$

$$0.75 l_{Cfull} \geq l_C \geq 0.75 r_1^2/d_C.$$

10. The core conductor of claim 9, wherein the electrical contact surface area is continuous.

11. The core conductor of claim 9, wherein the electrical contact surface area in not continuous, but comprises two or more distinct contacts.

12. The core conductor of claim 9, wherein $0.5\ l_{Cfull} \geq l_C \geq r_1^2/d_C$.

13. The core conductor of claim 1, wherein the conductor is rated for 1,000 A or more.

14. A single-pole, male electrical connector contact, comprising:

a generally cylindrical core having a minimum radius of $r_1$ and a length of $l_{Cfull}$;

an electrical contact surface area having a length $l_C$ and a diameter $d_C$, wherein the following are true:

$$d_C > 2r_1; \text{ and,}$$

$$0.75 l_{Cfull} \geq l_C \geq 0.75 r_1^2/d_C.$$

15. The contact of claim 10, wherein $0.5\ l_{Cfull} \geq l_C \geq 0.9\ r_1^2/d_C$.

16. The contact of claim 10, wherein $0.5\ l_{Cfull} \geq l_C \geq r_1^2/d_C$.

17. A single-pole, male electrical connector comprising:

a generally cylindrical core conductor with a minimum cross-sectional area $a_1$, an electrical contact region having an approximate total surface area $A_C$, and an electrical contact surface area $A_{Ceff}$ within the electrical contact region, wherein: $0.75\ A_C \geq A_{Ceff} \geq 0.75\ a_1$; and, an insulator positioned around the core conductor.

18. The connector of claim 17, wherein the core conductor has a cable crimp region configured for secure attachment to an electrical supply cable.

19. The connector of claim 17, further comprising a rigid housing positioned around the insulator and a flange for mounting the housing to a panel.

* * * * *